US006156950A

United States Patent [19]

Ragil et al.

[11] Patent Number: 6,156,950

[45] Date of Patent: Dec. 5, 2000

[54] PROCESS FOR SEPARATING A C5-C8 FEED OR AN INTERMEDIATE FEED INTO THREE EFFLUENTS, RESPECTIVELY RICH IN STRAIGHT CHAIN, NON-BRANCHED AND MULTI-BRANCHED PARAFFINS

[75] Inventors: Karine Ragil; Isabelle Prevost, both of Rueil Malmaison; Olivier Clause, Chatou; Joseph Larue, Rueil Malmaison; Benoît Millot, Laneuveville Devant Nancy, all of France

[73] Assignee: Institut Francais du Petrole, Rueil-Maimalson, France

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/199,351

[22] Filed: Nov. 25, 1998

[30] Foreign Application Priority Data

Nov. 25, 1997 [FR] France ..... 97/14.888

[51] Int. Cl.[7] ..... C07C 7/00; C07C 7/144; C07C 7/12; C07C 5/13; C10G 25/00

[52] U.S. Cl. ..... 585/802; 585/818; 585/820; 585/822; 585/826; 585/737; 585/738; 208/351; 208/310 Z; 208/310 R

[58] Field of Search ..... 585/802, 818, 585/820, 822, 826, 737, 738; 208/351, 310 R, 310 Z

[56] References Cited

U.S. PATENT DOCUMENTS

| | | | |
|---|---|---|---|
| 4,717,784 | 1/1988 | Stem et al. | 585/738 |
| 5,055,633 | 10/1991 | Volles | 585/826 |
| 5,107,259 | 4/1992 | Chen et al. | 585/818 |

FOREIGN PATENT DOCUMENTS

| | | |
|---|---|---|
| 384540 | 2/1990 | European Pat. Off. . |
| 473828 | 9/1990 | European Pat. Off. . |
| 93/19840 | 10/1993 | WIPO . |

*Primary Examiner*—Walter D. Griffin
*Assistant Examiner*—Tam M. Nguyen
*Attorney, Agent, or Firm*—Millen, White, Zelano & Branigan, P.C.

[57] ABSTRACT

For producing three effluents which are respectively rich in straight chain paraffins, in mono-branched paraffins, and in di-branched and tri-branched paraffins possibly with naphthenic and/or aromatic compounds, from C5–C8 cuts or intermediate cuts (C5–C7, C6–C8, C7–C8, C6–C7, C7 or C8), comprising paraffic and possibly naphthenic, aromatic and olefinic hydrocarbons, the separation process of the invention uses at least two separation units operating either by adsorption or by permeation. It is of particular application when coupled with a hydro-isomerization process, which selectively recycles straight chain and mono-branched paraffins, necessary with paraffins containing more than 7 carbon atoms.

26 Claims, 1 Drawing Sheet

PROCESS FOR SEPARATING A C5-C8 FEED OR AN INTERMEDIATE FEED INTO THREE EFFLUENTS, RESPECTIVELY RICH IN STRAIGHT CHAIN, NON-BRANCHED AND MULTI-BRANCHED PARAFFINS

SUMMARY OF THE INVENTION

The invention relates to a separation process for producing three effluents which are respectively rich in straight chain paraffins, in mono-branched paraffins, and in di-branched and tri-branched paraffins, possibly with naphthenic and/or aromatic compounds, from C5–C8 cuts or intermediate cuts (C5–C7, C6–C8, C7–C8, C6–C7, C7 or C8), comprising paraffinic and possibly naphthenic, aromatic and olefinic hydrocarbons. The separation process of the invention uses at least two separation units operating either by adsorption or by permeation. The process can also result from a combination of the two separation techniques. The process is suitable for liquid or gas phase operation. When separation uses at least one adsorption unit, separation can be carried out using adsorbents which can preferentially adsorb straight chain paraffins or using adsorbents which can preferentially adsorb mono-branched paraffins. When separation is by permeation, the isomerate can be separated using a gas permeation or pervaporation technique. The separation process of the invention is particularly suitable when coupled with the hydro-isomerization process described in the patent application entitled "High octane number gasolines and their production using a process associating hydro-isomerization and separation", filed by the Applicant on the same day, since it enables straight chain and mono-branched paraffins to be selectively recycled, necessary for paraffins containing at least 7 carbon atoms.

When the feed for the process comprises a C5 cut, isopentane from that cut can either be separated using the process of the invention with the mono-branched paraffins, or it can be extracted from the streams traversing the process using at least one deisopentanizer located upstream and/or downstream of the different separation units. In the latter case, the isopentane can act as an eluent or as a flushing gas for the adsorption or permeation separation units respectively.

Increasing environmental constraints have resulted in the removal of lead compounds from gasolines, effectively in the United States and Japan and becoming general in Europe. Aromatic compounds, the main constituents of reformed gasolines, and isoparaffins produced by aliphatic alkylation or isomerization of light gasolines initially compensated for the octane number loss resulting from removing lead from gasoline. Subsequently, oxygen-containing compounds such as methyl tertiobutyl ether (MTBE) or ethyl tertiobutyl ether (ETBE) were introduced into the fuels. More recently, the known toxicity of compounds such as aromatic compounds, in particular benzene, olefins and sulphur-containing compounds, as well as the desire to reduce the vapour pressure of the gasolines, led the United States to produce reformulated gasolines. As an example, the maximum amounts of olefins, aromatic compounds and benzene in gasoline distributed in California in 1996 were respectively 6% by volume, 25% by volume, and 1% by volume. Regulations are less severe in Europe, but nevertheless there is a clear tendency to reduce the maximum benzene, aromatic compound and olefin amounts in gasoline which is produced and sold to a similar level.

Gasoline pools contain a plurality of components. The major components are reformed gasoline, which normally comprises between 60% and 80% by volume of aromatic compounds, and catalytic cracking (FCC) gasolines which typically contain 35% by volume of aromatic compounds but provide the majority of olefinic and sulphur-containing compounds present in the gasoline pools. The other components can be alkylates, with neither aromatic compounds nor olefinic compounds, light gasolines which may or may not be isomerized, which contain no unsaturated compounds, oxygen-containing compounds such as MTBE, and butanes. Since the aromatic compound content is not reduced below 30% or 40% by volume, the contribution of reformates to gasoline pools remains high, typically 40% by volume. Increased severity as regards the maximum admissible amount of aromatic compounds to 20–25% by volume will result in a reduction in the use of reforming, and as a result the need to upgrade C7–C10 straight run cuts by routes other than reforming. Upgrading by hydro-isomerization is one possible route, as described in the patent application entitled "High octane number gasolines, and their production using a process associating hydro-isomerization and separation", filed by the Applicant on the same day. The hydro-isomerization process leads to the formation of multi-branched compounds from low octane number compounds. It can only be used to recycle straight chain and mono-branched C7–C10 paraffins, since the hydro-isomerization reaction is equilibrated and low octane number paraffins cannot be sent to the gasoline pool. Further, different hydro-isomerization conditions must be employed for those isomeric paraffins to avoid cracking the most highly branched paraffins. These two points justify research for separation processes which can produce three distinct effluents, respectively an effluent which is rich in straight chain paraffins, an effluent which is rich in mono-branched paraffins and an effluent which is rich in multi-branched paraffins and possibly in naphthenic and/or aromatic compounds.

The use of adsorption or permeation separation processes to separate straight chain, mono-branched and multi-branched paraffins has already been the subject of a number of patents (for example U.S. Pat. Nos. 4,717,784, 4,956,521; 5,233,120; 5,055,633; 4,367,364; and 4,517,402, as well as BE-A-891 522 and French patent 2,688,213.

However, those patents only concern light C5–C6 fraction, and, further, only concern the separation of those distillation cuts into two effluents, one with a low octane number and the other with a high octane number.

Similarly, U.S. Pat. Nos. 4,210,771 and 4,709,116 describe separating straight chain paraffins from a C5–C6 naphtha cut using a adsorbent known as calcium 5A zeolite. Further, U.S. Pat. No. 4,367,364 describes this same separation carried out using silicalite (U.S. Pat. No. 4,061,724). The separation processes described by those patents are often coupled with a process for isomerizing straight chain paraffins since those latter have a low octane number.

Similarly again, some patents (such as U.S. Pat. Nos. 4,717,784 and 4,804,802;) describe processes for separating straight chain paraffins and mono-branched paraffins from a C5–C6 cut. Such straight chain and mono-branched paraffins constitute the low octane number pool, while multi-branched paraffins constitute the high octane number pool. Those patents underline the importance of using adsorbents such as ferrierite (U.S. Pat. Nos. 4,804,802; and 4,717,784), ZSM-5 zeolites (U.S. Pat. No. 3,702,886), ZSM-11 (U.S. Pat. No. 4,108,881), ZSM-23 (U.S. Pat. No. 4,076,842) and ZSM-35 (U.S. Pat. No. 4,016,245) and silicalite (U.S. Pat. No. 5,055,633), since such adsorbents adsorb both straight chain and mono-branched compounds from C5–C6 cuts and exclude paraffins with higher degrees of branching. When using such adsorbents, isopentane is separated from the feed and is sent to the low octane number pool, with the straight chain and mono-branched paraffins, whereas the octane number of that compound is high. U.S. Pat. No. 5,055,633 thus underlines the importance of producing isopentane with the stream which is rich in multi-branched compounds, aromatic compounds and/or aromatic compounds from a C5–C6 feed. The feed contains at least 10 mole % of isopentane as well as C7+ compounds in quantities of less than 10 mole %. Such a process results in a secondary stream which is rich in straight chain paraffins and mono-branched paraffins which can be sent to an isomerization reactor.

Those patents do not envisage fractionating C5–C6 cuts into three effluents during isomerization for two reasons: firstly, the octane number of mono-branched C5–C6 paraffins is usually judged to be sufficient for those compounds to be sent to the gasoline pool, in which case such paraffins are separated with the multi-branched paraffins. Secondly, when the straight chain paraffins and the mono-branched paraffins are recycled to the isomerization step, it is no use separating them since those compounds can be isomerized under the same operating conditions, in contrast to heavier cuts such as those used in the present invention. U.S. Pat. No. 5,055,634 is the only patent to describe a process which could produce three streams respectively rich in straight chain paraffins, in mono-branched paraffins and in multi-branched paraffins from a light C5–C6 cut, but its main importance, as described in the process of U.S. Pat. No. 5,055,633, lies in the possibility of separating and producing isopentane with the stream which is rich in multi-branched paraffins. The feed for such a process contains at least 10% of isopentane. It is centred around C5–C6 and can sometimes contain small quantities of paraffins containing seven or more carbon atoms. As a result, the process described in that patent is suitable for contents of those C7+ compounds of less than 10 mole %. That process is carried out in two units disposed in series. The feed arrives in the first unit which contains an adsorbent which can selectively retain straight chain paraffins. The effluent from that unit is then constituted by mono- and multi-branched paraffins. That denormalized effluent is then introduced into the second unit which is filled with an adsorbent which can preferentially retain mono-branched paraffins with the exception of isopentane, which is produced with the multi-branched paraffins. That patent indicates that the two units are regenerated using a non adsorbable gas such as hydrogen. That gas passes firstly through the second unit and desorbs mono-branched paraffins. At least a portion of that stream is then sent to the first unit and desorbs straight chain paraffins contained therein. That regeneration mixes a portion of the mono-branched paraffins with the straight chain paraffins previously separated with the exception of isopentane, which is recovered with the high octane number compounds in the production stream. In a preferred version of the process, all of the desorption streams leaving the second unit pass through the first to minimize the quantity of non adsorbable gas required to regenerate the two units. In the latter case, the process produces only two streams, the first being rich in multi-branched paraffins, naphthenic compounds, aromatic compounds and isopentane, the second being rich in straight chain and mono-branched paraffins. Such a separation can thus be carried out using a single adsorber containing two types of adsorbents as described in one example described in that patent.

The adsorption and permeation separation techniques used in those different patents to upgrade C5–C6 cuts are known in the art. Thus processes for separation by adsorption can be based on PSA (pressure swing adsorption), TSA (temperature swing adsorption), chromatography (elution chromatography or simulated counter-current chromatography, for example), or they result from a combination of the above. Such processes all involve bringing a liquid or gaseous mixture into contact with a fixed bed of adsorbent to eliminate certain constituents of the mixture which may be adsorbed. Desorption can be accomplished by various means. Thus the common characteristic of PSA is to regenerate the bed by depressurization and in certain cases by low pressure flushing. PSA type processes are described in U.S. Pat. No. 3,430,418 or in the more general work by Yang ("Gas Separation by Adsorption Processes", Butterworths, U S, 1987). Cycles based on using different arrangements of beds are described in particular detail. In general, PSA type processes are operated sequentially using all of the adsorption beds in alternation. Such PSA techniques have been very successful in the natural gas industry, for separating compounds of air, for producing solvents, and in various refining sectors.

TSA processes use temperature as the driving force for desorption and were the first to be developed for adsorption. The bed to be regenerated is heated by circulating a preheated gas, in a closed or an open loop, in a direction which is the reverse of that of adsorption. A number of variations (see "Gas Separation by Adsorption Processes", Butterworths, U S, 1987) are used depending on local constraints and on the nature of the gas employed. The technique is generally used in purification processes (drying, desulfuration of gas and liquids, purification of natural gas: U.S. Pat. No. 4,770,676).

Liquid or gas phase chromatography is a highly effective separation technique because a very large number of theoretical plates is used. It can thus exploit relatively low adsorption selectivities and accomplish difficult separations. The N-ISELF® process from Elf Aquitaine (BE-A-891 522) for separating n/iso-paraffins, and the ASAHI process (Seko M., Miyake J., Inada K.: Ind. Eng. Chem. Prod. Res. Develop., 1979, 18, 263) for separating paraxylene and ethylbenzene from an aromatic C8 cut use this type of operation. Stiff competition for such processes is provided by simulated moving bed or simulated counter current continuous processes. The latter have been largely developed in the petroleum industry (U.S. Pat. Nos. 3,633,121 and 3,997,620). Regeneration of the adsorbent uses the technique of displacement by a desorbent which must be capable of being separated by distilling the extract and the raffinate.

The advantage of permeation separation techniques over adsorption techniques is that they are continuous and, as a result, relatively simple to carry out. Further, they are recognised for their modularity and compactness. Over the past ten years they have taken their place beside adsorption and gas separation techniques, for example for recovering hydrogen from refining gas, decarbonating natural gas, and producing inerting nitrogen ("Handbook of Industrial Membranes", Elsevier Science Publishers, UK, 1995). Their use in separating isomeric hydrocarbons is rendered possible because of the recent advances in techniques for synthesising materials and more particularly in the inorganic material synthesis field where zeolite crystals can now be grown in the form of a thin continuous supported or self supported layer.

International patent application WO-A-96/01687 describes a method for synthesising a supported zeolite membrane and its applications, in particular separating a mixture of normal- and iso-pentane. A further method for synthesising a supported zeolite membrane adapted for separating straight-chain alkanes from a mixture of more highly branched hydrocarbons is described in International patent WO 93/19840.

The permeabilities of straight-chain and branched hydrocarbons have been reported in the literature for films of self supported zeolite or zeolite deposited on supports of different natures. As an example, Tsikoyiannis, J. G. and Haag, W. O., in Zeolite 1992, 12, 126–30, observed a permeability ratio of 17.2 for nC6 with respect to iC6 on a self supported ZSM-5 film.

Permeability measurements in pure gases on a membrane composed of silicalite crystals on a porous steel support have shown that the nC4 stream is larger than the iC4 stream (Geus, E. R.; Van Bekkum, H.; Bakker, W. J. W.; Moulijn, J. A. Microporous Mater. 1993, 1, 131–47). For these same gases the ratio of permeabilities (nC4/iC4) is 18 at 30° C. and 31 at 185° C. with a membrane constituted by ZSM-5 zeolite on a porous alumina support. Regarding the separation of nC6/2,2-dimethylbutane, a selectivity of 122 was measured with a silicalite membrane on a porous glass support (Meriaudeau P.; Thangaraj A.; Naccache C; Microporous Mater, 1995, 4, 213–219).

The invention provides a separation process for producing three effluents, respectively rich in straight chain paraffins, in mono-branched paraffins and in di-branched and tri-branched paraffins and possibly in naphthenic and/or aromatic compounds from light C5–C8 cuts or intermediate cuts, such as C5–C7, C6–C8, C7–C8, C6–C7, C7 or C8, comprising paraffinic and optionally naphthenic, aromatic and/or olefinic hydrocarbons. The separation process of the invention uses at least two separation units disposed in series operating either by adsorption or by permeation (using one or more membranes). The process can also result from a combination of these separation techniques. The process of the invention is suitable for liquid or gas phase operation. Such a separation process is of particular application when it is coupled with a hydro-isomerization process as described in the patent application entitled "High octane number gasolines and their production using a process associating hydro-isomerization and separation" filed by the Applicant on the same day. The process described necessitates recycling of both the straight chain paraffins (nCx, x=5 to 8) and mono-branched paraffins (monoC$_{(x-1)}$, since the octane numbers of the straight chain and mono-branched C7–C8 paraffins are low (see Table 1 below). Further, different hydro-isomerization conditions must be employed for the two types of isomers to avoid cracking of the most highly branched paraffins. These two points justify research for a separation process which can produce three distinct effluents, respectively rich in straight chain paraffins nCx, in mono-branched paraffins (monoC$_{(x-1)}$), and in multi-branched paraffins (diC$_{(x-2)}$ or triC$_{(x-3)}$), naphthenic compounds and/or aromatic compounds.

TABLE 1

| Paraffin | nC7 | monoC6 | diC5 | triC4 | nC8 | monoC7 | diC6 | triC5 |
|---|---|---|---|---|---|---|---|---|
| RON | 0 | 42–52 | 80–93 | 112 | <0 | 21–27 | 55–76 | 100–109 |
| MON | 0 | 23–39 | 84–95 | 101 | <0 | 23–39 | 56–82 | 96–100 |

In a first version of the process, a first separation unit separates straight chain paraffins from branched paraffins. This unit produces a denormalized feed which is sent to a second separation unit, which separates the mono-branched paraffins from the multi-branched paraffins and naphthenic and/or aromatic compounds.

In a second version of the process, the first unit separates multi-branched paraffins and naphthenic and/or aromatic compounds from the straight chain and mono-branched paraffins. These latter are sent to a second separation unit for separation into two effluents, one rich in mono-branched paraffins, and the other rich in straight chain paraffins. Regeneration of the units, when they use one or more adsorbents, is always independent in that they do not contribute to mixing the different isomers which have been separated. When the feed for the process comprises a C5 cut, isopentane from this cut can either be separated by the process with the mono-branched paraffins, or extracted from the stream traversing the process using a deisopentanizer disposed upstream or downstream of the different separation units. In the latter case, the isopentane can act as an eluent or as a flushing gas for the adsorption or permeation separation units respectively.

DETAILED DESCRIPTION OF THE INVENTION

Figure 1:
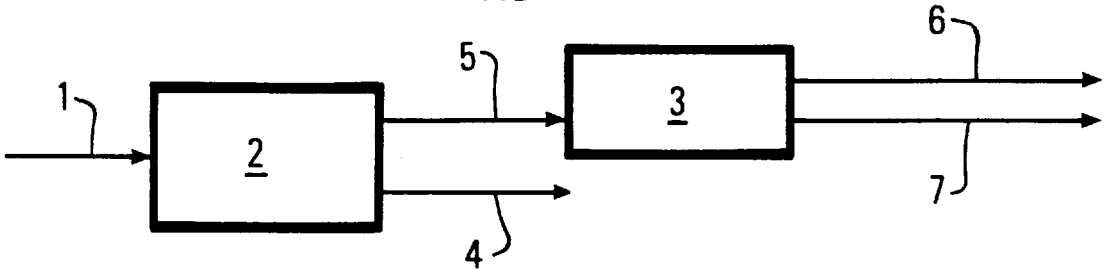

The feed treated in the process of the invention originates from a C5–C8 cut or any intermediate cuts (such as C5–C7, C6–C8, C6–C7, C7–C8, C7 or C8) from atmospheric distillation, from a reforming unit (light reformate) or from a conversion unit (naphtha hydrocracking, for example). In the remainder of the text, this set of possible feeds will be designated by the term "C5–C8 cuts and intermediate cuts".

It is mainly composed of straight-chain, mono-branched and multi-branched paraffins, naphthenic compounds such as dimethylcyclopentanes, aromatic compounds such as benzene or toluene and possibly olefinic compounds. The term "multi-branched paraffins" includes all paraffins with a degree of branching of two or more.

The feed can contain normal pentane, 2-methylbutane, neopentane, normal hexane, 2-methylpentane, 3-methylpentane, 2,2-dimethylbutane, 2,3-dimethylbutane, normal heptane, 2-methylhexane, 3-methylhexane, 2,2-dimethylpentane, 3,3-dimethylpentane, 2,3-dimethylpentane, 2,4-dimethylpentane, 2,2,3-trimethylbutane, normal octane, 2-methylheptane, 3-methylheptane, 4-methylheptane, 2,2-dimethylhexane, 3,3-dimethylhexane, 2,3-dimethylhexane, 3,4-dimethylhexane, 2,4-dimethylhexane, 2,5-dimethylhexane, 2,2,3-trimethylpentane, 2,3,3-trimethylpentane, and 2,3,4-trimethylpentane. When the feed originates from C5–C8 cuts or intermediate cuts (such as C5–C7, C6–C8, C6–C7, C7–C8, C7, C8) obtained after atmospheric distillation, it can also contain cyclic alkanes such as dimethylcyclopentanes, aromatic hydrocarbons (such as benzene, toluene, xylenes) and other C9+ hydrocarbons (i.e., hydrocarbons containing at least 9 carbon atoms) in small quantities. The C5–C8 cuts or intermediate cuts from reformates can also contain olefinic hydrocarbons, in particular when the reforming units are operated at low pressure.

The amount of paraffins (P) essentially depends on the origin of the feed, i.e., on its paraffinic or naphthenic and aromatic character, sometimes measured using the parameter N+A (the sum of the amount of naphthenes (N) and the amount of aromatic compounds (A)), also its initial point, i.e., the amount of C5 and C6 in the feed. In hydrocracked naphthas, which are rich in naphthenic compounds, or light reformates, which are rich in aromatic compounds, the amount of paraffins in the feed will generally be low, of the order of 30% by weight. In straight run C5–C8 cuts or intermediate cuts (such as C5–C7, C6–C8, C6–C7, C7–C8, C7, C8), the amount of paraffins varies between 30% and 80% by weight, with an average value of 55–60% by weight.

The feed which is rich in paraffins containing between 5 and 8 carbon atoms generally has a low octane number and the process of the invention consists of fractionation into three distinct effluents with increasing motor and research octane numbers, respectively rich in straight chain paraffins, in mono-branched paraffins and in di-branched, tri-branched and possibly in naphthenic and/or aromatic compounds.

To this end, a minimum of two separation units are used. A number of versions of the process are possible, depending on the arrangement of the different units.

For each of the versions of the process of the invention, separation is accomplished in the liquid or gas phase using processes using adsorbents or membranes. The adsorption separation processes used can be PSA (pressure swing adsorption), TSA (temperature swing adsorption), chromatography (elution chromatography or simulated counter current chromatography, for example) or it can be a combination of these methods. The separation units can use one or more molecular sieves. Further, in general a plurality of separation units (two to ten) are used in parallel and in alternation to result in a continuous process even though adsorption processes are batch processes by nature. When separation is accomplished by permeation, the isomerate can be separated using a gas permeation or pervaporation technique.

Version 1 of the process is illustrated in FIG. 1. Fresh feed (stream 1) containing straight chain, mono-branched and multi-branched paraffins, naphthenic compounds and/or aromatic compounds arrives at separation unit 2. Normal paraffins (stream 4) from C5–C8 cuts or intermediate cuts (C5–C7, C6–C8, C6–C7, C7–C8, C7, C8) are separated from the feed in unit 2. The characteristics of the adsorbents and the membranes which can accomplish such separation will be given below. Unit 2 supplies unit 3 with a denormalized feed 5. Mono-branched paraffins (stream 6) in this feed are separated from denormalized feed 5 in unit 3. The characteristics of the adsorbents and the membranes which can accomplish such separation are given below. Unit 3 produces two effluents, one rich in multi-branched paraffins, naphthenic compounds and/or aromatic compounds (stream 7), the other rich in mono-branched paraffins (stream 6). This process thus fractionates a C5–C8 or any intermediate feed into three effluents 4, 6 and 7 with increasing research and motor octane numbers.

Figure 2:
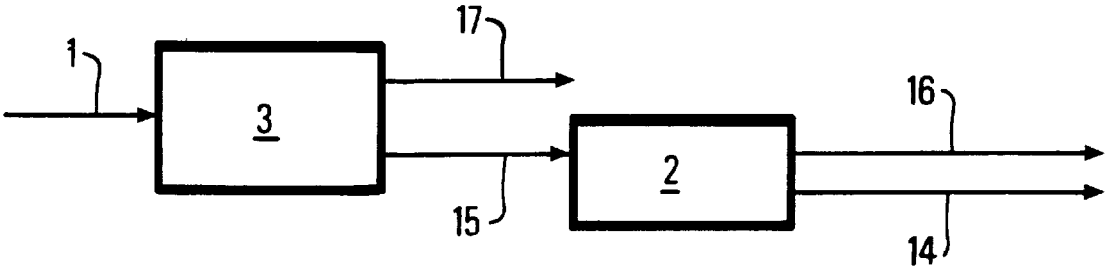

Version 2 of the process is illustrated in FIG. 2. Fresh feed (stream 1) containing straight chain, mono-branched and multi-branched paraffins, naphthenic compounds and/or aromatic compounds arrives at separation unit 3. Multi-branched paraffins, naphthenic compounds and/or aromatic compounds (stream 17) from the C5–C8 cut or intermediate cuts (C5–C7, C6–C8, C6–C7, C7–C8, C7, C8) are separated from the feed in unit 3. The characteristics of the adsorbents and the membranes which can accomplish such separation will be given below. Unit 3 supplies unit 2 with a low octane number feed 15 essentially containing straight chain and mono-branched paraffins. The mono-branched paraffins (stream 16) in this feed will be separated from feed 15 in unit 2. The characteristics of the adsorbents and the membranes which can accomplish such separation will be given below. Unit 2 produces two effluents, one rich in straight chain paraffins (stream 14), the other rich in mono-branched paraffins (stream 16). This process thus fractionates a C5–C8 or any intermediate feed into three effluents 14, 16 and 17 with increasing research and motor octane numbers.

For each of these two versions, when feed 1 contains a C5 cut, isopentane from that cut can either be separated by the process of the invention with the mono-branched paraffins, or it can be extracted from the streams traversing the process using at least one deisopentanizer disposed upstream and/or downstream of the different separation units. In the latter case, isopentane can act as an eluent or as a flushing gas for the adsorption or permeation separation units respectively.

The process comprises at least two units which can operate using an adsorbent or a membrane. The process can be the result of an association of at least one unit operating by adsorption with the aim of carrying out one of the separations and at least one membrane unit for carrying out the other separation of the invention.

When at least one of the units operates by adsorption, it is filled with a natural or synthetic adsorbent which can either separate straight chain paraffins from mono-branched, multi-branched, naphthenic and/or aromatic compounds (version 1, unit 2), or the same straight chain paraffins from mono-branched paraffins (version 2 unit 2), or multi-branched paraffins, naphthenic compounds and/or aromatic compounds from mono-branched paraffins (version 1 unit 3) or these same compounds from mono-branched and straight chain paraffins (version 2 unit 3). Separation using such adsorbents is made on the basis of differences in the geometrical, diffusional or thermodynamic properties of the adsorbates for the adsorbents under consideration. A large number of adsorbent materials can carry out this type of separation. Among them are carbon, activated clay, silica gel, and activated alumina molecular sieves and crystalline molecular sieves. These latter have a uniform pore size and for this reason are particularly suitable for separation. Such molecular sieves include the different forms of silicoaluminophosphates and aluminophosphates described in U.S. Pat. Nos. 4,444,871, 4 310 440 and 4,567,027 as well as zeolitic molecular sieves. These, in their calcined form, can be represented by the chemical formula:

$$M_{2/n}O: Al_2O_3: xSiO_2: yH_2O$$

where M is a cation, x is in the range 2 to infinity, y is in the range 2 to 10 and n is the valency of the cation. When separating straight chain paraffins (stream 4) from feed 1 (unit 2, version 1), or the same straight chain paraffins (stream 14) from mono-branched paraffins (stream 16) (unit 2, version 2), adsorbents with a pore size which is sufficient to allow straight chain paraffins to adsorb and exclude larger sized molecules such as mono-branched paraffins, multi-branched paraffins and naphthenic and/or aromatic compounds are used. Zeolites which are particularly suitable are type A zeolites described in U.S. Pat. No. 2,882,243 which in the majority of their cation exchanged forms, in particular in the calcium form, have pore diameters of the order of 5

Å and have large capacities for adsorbing straight chain paraffins. The term "effective pore diameter" is a conventional term in the art. It is a functional measurement used to define pore size in terms of the size of molecule which can enter the pore. It does not define the actual dimension of the pore as that is often difficult to determine since the pore is usually irregular in shape (i.e., non circular). D. W. Breck discusses the effective pore diameter in his book entitled "Zeolite Molecular Sieves", John Wiley and Sons, New York, 1974), pages 633 to 641. Other molecular sieves including, for example, R zeolite (U.S. Pat. No. 3,030,181), T zeolite (U.S. Pat. No. 2,950,952), silicoaluminophosphates and aluminophosphates (U.S. Pat. Nos. 4,440,871, 4,310,440; and 4,567,027), also natural zeolites such as clinoptilolite, chabazite and erionite are suitable for carrying out the separations made in unit 2 in versions 1 and 2. Finally, a sieve such as ferrierite (U.S. Pat. Nos. 4,804,802 and 4,717,784), ZSM-5 zeolites (U.S. Pat. No. 3,702,886), ZSM-11 (U.S. Pat. No. 4,108,881), ZSM-23 (U.S. Pat. No. 4,076,842) and ZSM-35 (U.S. Pat. No. 4,016,245) and silicalite (U.S. Pat. No. 5,055,633) is also perfectly suitable for the separations carried out in unit 2 of versions 1 and 2, since the different diffusional properties of the isomers in them can be exploited. Details of adsorption of straight chain paraffins on each of these sieves are known to the skilled person and will not be gone into here in great deal.

When adsorbing either mono-branched paraffins from stream 5 which is rich in mono- and multi-branched paraffins, naphthenic compounds and/or aromatic compounds (unit 3, version 1), or mono-branched and straight chain paraffins from feed 1 (unit 3, version 2), microporous molecular sieves with an effective pore diameter of more than 5 Å are preferred. Among these are sieves with elliptical pore cross sections with dimensions in the range 5.0 Å to 5.5 Å along the minor axis and about 5.5 to 6.0 Å along the major axis. An adsorbent with these characteristics, and thus particularly suitable for the present invention, is silicalite. The term "silicalite" includes here both silicopolymorphs described in U.S. Pat. No. 4,061,724 and F silicalite described in U.S. Pat. No. 4,073,865. Other adsorbents with the same characteristics and thus which are particularly suitable for our application are ZSM-5, ZSM-11, ZSM-35 (U.S. Pat. No. 4,016,245), ZSM-48 and numerous other analogous crystalline aluminosilicates. ZSM-5 and ZSM-11 are described in U.S. Pat. No. 3,702,948, U.S. Pat. No. RE 29,948 and U.S. Pat. No. 3,709,979. The amount of silica in these adsorbents can vary. Adsorbents which are the most suitable for this type of separation are those with high silica contents. The Si/Al molar ratio should preferably be at least 10 and more preferably over 100. A further type of adsorbent which is particularly suitable for our application contains elliptical cross section pores with dimensions in the range 4.5 Å to 5.5 Å. This type of adsorbent has been described in U.S. Pat. No. 4,717,748, for example, as being a tectosilicate with a pore size intermediate between that of pores of a calcium 5A sieve and the pores of ZSM-5. Preferred adsorbents from this family include ZSM-23 described in U.S. Pat. No. 4,076,872 and ferrierite described in U.S. Pat. Nos. 4,016,425 and 4,251,499.

These different adsorbents have pore sizes such that each of the isomers of C5–C8 or intermediate cuts can be adsorbed. The diffusion kinetics for these isomers is, however, sufficiently different to be usefully exploited. Under certain operating conditions, these molecular sieves can carry out each of the separations corresponding to units 2 or 3 of versions 1 and 2 of the present invention.

When the separation technique is permeation, the membrane used can be in the form of hollow fibres, bundles of tubes, or a stack of plates. Such configurations are known in the art and ensure homogeneous distribution of the fluid to be separated over all of the membrane surface, maintaining the pressure difference from one side to the other of the membrane, and recovering the fluid which has permeated separately from that which has not permeated (the retentate). The selective layer can be formed from one of the adsorbent materials described above providing that it can form a uniform surface delimiting a section in which at least a portion of the feed can circulate, and a section in which at least a portion of the fluid which has permeated circulates.

The selective layer can be deposited on a permeable support which provides the mechanical strength of the membrane so constituted, as described in WO 96/01687 or WO 93/19840.

The selective layer is preferably formed by growing crystals of zeolite from a microporous support as described in European patents EP-A-0 778 075 and EP-A-0 778 076. In a preferred mode of the invention, the membrane is constituted by a continuous layer of silicalite crystals about 40 microns thick, bonded to an alpha alumina support with a 200 nm pore size.

The operating conditions will be selected so as to maintain a chemical potential difference of the constituent(s) to be separated over the whole membrane surface to encourage their transfer through the membrane. The pressures either side of the membrane must allow average differences of 0.05 to 1 MPa for the transmembrane partial pressures of the constituents to be separated.

To reduce the partial pressure of the constituents, it is possible to use a flushing gas or to maintain the vacuum using a vacuum pump at a pressure which, depending on the constituents, can be from 100 Pa to $10^4$ Pa and to condense vapours at very low temperatures, typically about −40° C. Depending on the hydrocarbons used, the temperatures should not exceed 200° C. to 400° C. to limit cracking and/or coking of olefinic and/or aromatic hydrocarbons in contact with the membrane. The rate of feed circulation is preferably such that it flows turbulently.

The operating conditions for the two separation units depend on its implementation and on the adsorbent or membrane under consideration, also on the separation to be carried out. They are in the temperature range 50° C. to 450° C., and in the pressure range 0.01 MPa to 7 MPa. More precisely, if separation is carried out in the liquid phase, the separation conditions are: a temperature of 50° C. to 200° C. and a pressure of 0.1 MPa to 5 MPa. If said separation is carried out in the gas phase, these conditions are generally: a temperature of 150° C. to 450° C. and a pressure of 0.01 MPa to 7 MPa.

Compared to version 2 of the process, version 1 of the process minimizes the quantity of adsorbent or membrane surface necessary for separation in unit 3. In version 2, depending on the separation technique used, using unit 3 involves either adsorbing sets of straight chain and mono-branched paraffins, or their passage through the membrane. In version 1, operation of unit 3 involves a single adsorption of mono-branched compounds or respectively passage through a membrane of these isomers alone (the permeate is constituted by mono-branched compounds only).

When the feed for the process comprises a C5 cut, isopentane from this cut can either be separated by the process with the mono-branched paraffins, or it can be extracted from the streams traversing the process using a deisopentanizer. The latter can be disposed either in feed 1, or in streams 5 or 6 for version 1 or in streams 1, 15 or 16 for version 2. Such an operation optimises stream management for the process since the separated isopentane can act as an eluent or as a flushing gas for the adsorption or permeation separation units respectively. The disposition of the deisopentanizer in stream 6 (version 1) and streams 15 or 16 (version 2) respectively shows that the isopentane is preferably separated with the mono-branched compounds and not with the multi-branched compounds under the operating conditions of the separation sections. The invention including deisopentanizing is thus clearly distinguished from those connected with U.S. Pat. Nos. 5,055,633 and 5,055,634.

It may also be advantageous to locate a depentanizer in streams 1 and/or 4 for version 1 and in stream 1 and/or 15 and/or 14 for version 2. If the depentanizer is located in stream 1, for version 1 or in streams 1 and 15 for version 2, it can be followed by a deisopentanizer with the aim of using either an isopentane/pentane mixture or each of the pure entities independently in the process. These pure entities or mixture can thus act as an eluent or as a flushing gas for the adsorption or permeation separation units respectively.

Finally, and similarly, for cuts containing no C5 but containing C6, the process can include a deisohexanizer located in streams 1, 5 or 6 for version 1 or in streams 1, 15 and 16 for version 2. Such an arrangement optimises stream management for this process since the separated mono-branched C6 compounds can act as an eluent or as a flushing gas for the adsorption or permeation separation units respectively.

The entire disclosure of all applications, patents and publications, cited above and below, and of corresponding French application 97/14 888, filed Nov. 25, 1997, are hereby incorporated by reference.

The following examples illustrate the invention.

EXAMPLES

Example 1

Process for separating into three effluents using two units operating by gas phase adsorption In order to illustrate version 1 of the invention, an example will now be given in which two separations were carried out using gas phase adsorption employing the PSA technique, using a straight run C5–C8 cut comprising paraffinic, naphthenic, aromatic and olefinic hydrocarbons.

The fresh feed for the process had the composition shown in Table 2 and as a result a research octane number of 73.1 and a motor octane number of 70.33.

TABLE 2

| Components | Weight, % |
|---|---|
| iC4 | 0.01 |
| nC4 | 0.46 |
| nC5 | 9.10 |
| iC5 | 6.10 |
| cyclopentane | 0.61 |
| nC6 | 6.38 |
| mono-branched C6 | 6.43 |
| di-branched C6 | 1.31 |
| cyclohexane | 3.87 |
| methylcyclopentane | 3.01 |
| nC7 | 6.23 |
| mono-branched C7 | 4.18 |
| di-branched C7 | 2.43 |
| tri-branched C7 | 0.46 |
| dimethylcycloC5 | 4.24 |
| methylcycloC6 | 20.10 |
| nC8 | 2.91 |
| mono-branched C8 | 2.18 |

TABLE 2-continued

| Components | Weight, % |
|---|---|
| di-branched C8 | 1.31 |
| tri-branched C8 | 0.64 |
| trimethylcycloC5 | 6.00 |
| ethylbenzene | 0.92 |
| toluene | 10.00 |
| benzene | 1.16 |

Fresh feed arrived via line 1 at a rate of 26.29 kg/h. This feed was deisopentanized in a first deisopentanizer. The light fraction recovered from the head of the first deisopentanizer No.1 had the composition shown in Table 3, a research octane number of 92.4 and was at a rate of 1.73 kg/h. This fraction was used as a flushing, gas for the PSA process in separation unit 2.

TABLE 3

| Component | Weight, % |
|---|---|
| nC4 | 7.00 |
| iC4 | 0.15 |
| iC5 | 92.85 |

The deisopentanized feed, pre-heated to 250° C. and at a pressure of 1.4 MPa, arrived in separation unit 2. This unit comprised 4 adsorbers which were cylinders with an internal diameter of 0.053 m and a length of 4.77 m, each containing 8.05 kg of 5A molecular sieve (or 5A zeolite), in the form of 1.2 mm diameter beads. The feed and desorbent were supplied to the separation unit at a controlled flow rate and the effluents were recovered under controlled pressure. In the four-adsorber PSA, each of the adsorption beds underwent the following steps in a cycle:

1. Pressurization: the deisopentanized feed (24.66 kg/h) penetrated into the bed which contained desorption gas at low pressure. The pressure rose in the adsorber as the feed was introduced, until an adsorption pressure of 1.4 MPa had been reached.

2. Adsorption: the feed was sent co-currently with the pressurisation step to the bed and straight chain paraffins were selectively adsorbed onto the 5A zeolite, while the mono- and multi-branched paraffins and the aromatic and naphthenic compounds were produced as an effluent in this high pressure adsorber.

3. Depressurization: when the adsorbent was sufficiently loaded with straight chain paraffins, a depressurization step to 0.3 MPa was carried out co-currently with the pressurisation and adsorption steps. During this step, a large part of the mono- and multi-branched paraffins contained in the dead volume of the adsorber were produced.

4. Stripping by flushing gas: the light fraction produced by deisopentanizers No.1 and No.2 was used as a flushing gas to desorb the majority of the straight chain paraffins from the 5A sieve.

The operation described above was that of one of the adsorbers. The four adsorbers which formed separation unit 2 operated in the same way but were offset to result in continuous production of two effluents. The stripping stream containing straight chain paraffins and isopentane was produced at a flow rate of 18.95 kg/h and with a research octane number of 69.47. This stream was then sent to deisopentanizer No.2 to obtain isopentane which was recycled to separation unit 2 as a flushing gas, at a flow rate of 12.3 kg/h, and the desired straight chain paraffins (stream 4) at a flow rate of 6.65 kg/h and with a research octane number of 27

(composition given in Table 4). This stream 4 contained traces of mono-branched paraffins in an amount of 5%. The production stream 5 which was rich in mono- and multi-branched paraffins, and in naphthenic and/or aromatic compounds, was produced at a flow rate of 16.64 kg/h and with an octane number of 89.9. This stream contained 9% isopentane and 0.25% straight chain paraffins. Stream 5 was then sent to separation unit 3. This unit also operated using the PSA separation technique. It included 4 adsorbers which were cylinders with a 0.04 m internal diameter and a length of 5.7 m, each containing 5.47 kg of silicalite, in the form of 1.2 mm diameter beads. Each of the adsorption beds of unit 3 underwent the same cyclical steps as those described for unit 2. During the pressurisation and adsorption steps, the adsorbers were supplied with a stream which was rich in mono-branched paraffins, multi-branched paraffins, naphthenic compounds and/or aromatic compounds (stream 5). Under the separation conditions employed, the mono-branched paraffins were preferentially adsorbed on the silicalite, displacing the adsorbed isopentane present in the adsorber following the stripping step. Under the adsorber operating conditions, multi-branched paraffins, aromatic compounds and naphthenic compounds were not adsorbed and were produced as an effluent from the high pressure adsorber (1.4 MPa). The co-current depressurization step to 0.3 MPa produced a large portion of the non adsorbed compounds contained in the dead volume of the adsorber. Finally, a fraction of the isopentane from deisopentanizer No.3 was then used as a flushing gas to desorb the majority of mono-branched paraffins from the silicalite. The isopentane could reduce the partial pressure of the adsorbed mono-branched compounds and could also displace these compounds because of its own adsorption by the silicalite. The four adsorbers which formed separation unit 3 operated in the same way but were offset to result in continuous production of two effluents. The flushing gas containing the mono-branched paraffins and isopentane was produced at a rate of 10.58 kg/h. It contained 5.48% of di-branched paraffins and had an octane number of 82.9. This stream was then sent to deisopentanizer No.3 to produce isopentane which was recycled to separation unit 3 as a desorption gas and the desired mono-branched paraffins (stream 6: flow rate 3.6 kg/h, octane number 65.3, composition shown in Table 4). The production stream 7, rich in multi-branched paraffins and in naphthenic and/or aromatic compounds, was produced at a flow rate of 15.17 kg/h. This stream also included 5.9% of isopentane, and 0.4% of mono-branched paraffins. Its composition is given in Table 4 and its octane number was 92.8.

This process required a recycle, in a closed loop, of a certain quantity of isopentane between deisopentanizers No.2 and No.3 and separation units 2 and 3. The flow rate of the desorption gas could be adjusted depending on the specifications of the separation unit. A portion of this desorption gas circulating in the closed loop could be recovered:

in streams 4, 6, 7 and preferably in stream 7 containing di-branched paraffins and naphthenic and/or aromatic compounds;

in the light fractions from deisopentanizers No.2 and No.3.

This quantity of desorption gas so recovered corresponded to the quantity of light fraction extracted by deisopentanizer No.1 from the fresh feed, the composition of which is shown in Table 3. In Example 1, 52% of the isopentane introduced into the feed was in stream 7, and the essential portion of the remaining quantity was removed from the head of deisopentanizer No.3.

TABLE 4

| Composition of stream 4, rich in straight chain paraffins | (wt %) | Composition of stream 6, rich in mono-branched paraffins | (wt %) | Composition of stream 7, rich in multi-branched paraffins | (wt %) |
|---|---|---|---|---|---|
| nC5 | 33.8 | | | isopentane | 5.9 |
| nC6 | 25.2 | mono-branched C6 | 42.5 | di-branched C6 | 2.27 |
| nC7 | 24.6 | mono-branched C7 | 27.52 | di-branched C7 | 4.22 |
| nC8 | 11.4 | mono-branched C8 | 14.2 | di-branched C8 | 2.27 |
| mono-branched compounds | 5 | di-branched compounds | 15.7 | mono-branched compounds | 0.45 |
| | | straight chain | 0.08 | naphthenes | 64.2 |
| | | | | aromatics | 20.7 |
| RON | 27 | | 65.3 | | 92.8 |

Overall, the process of the invention led to the production of three effluents, respectively rich in straight chain paraffins, in mono-branched paraffins and in multi-branched paraffins, naphthenic compounds and/or aromatic compounds, from a straight run C5–C8 cut comprising paraffinic, naphthenic and/or aromatic compounds.

Example 2

Process for separation into three effluents using two reactors, one operating by liquid phase adsorption and the other by gas permeation In order to illustrate version 2 of the invention, an example will now be given in which the first separation step was carried out using liquid phase adsorption employing a simulated counter-current technique, using a straight run C5–C8 cut comprising paraffinic, naphthenic, aromatic and olefinic hydrocarbons.

The fresh feed for the process had the composition indicated in Table 5 and as a result a research octane number of 65.06 and a motor octane number of 63.53.

TABLE 5

| Components | Weight, % |
|---|---|
| iC4 | 0.02 |
| nC4 | 0.91 |
| nC5 | 15.23 |
| iC5 | 9.50 |
| cyclopentane | 0.73 |
| nC6 | 15.80 |
| mono-branched C6 | 12.61 |
| di-branched C6 | 5.30 |
| cyclohexane | 2.34 |
| methylcyclopentane | 3.27 |
| nC7 | 7.45 |
| mono-branched C7 | 3.95 |
| di-branched C7 | 1.06 |
| tri-branched C7 | 1.20 |
| dimethylcycloC5 | 4.58 |
| methylcycloC6 | 3.79 |
| nC8 | 1.12 |
| mono-branched C8 | 0.93 |
| di-branched C8 | 0.77 |
| tri-branched C8 | 0.28 |
| trimethylcycloC5 | 4.03 |
| ethylbenzene | 0.99 |
| toluene | 3.17 |
| benzene | 0.41 |

Fresh feed arrived via line 1 at a rate of 25.75 kg/h. This feed was deisopentanized in a first deisopentanizer. The light fraction recovered from the head of the first deisopentanizer No.1 had the composition shown in Table 6, a research octane number of 92.4 and was at a flow rate of 2.68 kg/h. This fraction was used as a flushing gas for the gas permeation unit (separation unit 2).

TABLE 6

| Component | Weight, % |
|---|---|
| nC4 | 8.75 |
| iC4 | 0.15 |
| iC5 | 91.1 |

The deisopentanized feed, pre-heated to 100° C. and at a pressure of 1.8 MPa, supplied separation unit 3, which consisted of an adsorption unit operating in simulated counter-current mode (SCC). This unit comprised a plurality of columns in series constituted by cylinders with an internal diameter of 0.1 m. The complete unit was 15 m long and contained 95 kg of silicalite, formed into beads 0.7 mm in diameter. The feed and desorbent (from deisopentanizers No.2 and No.3 which will be described below) supplied separation unit 3 operating under controlled flow rate (respectively 23.07 kg/h and 57.65 kg/h) and the effluents were recovered under controlled pressure. In the SCC unit, the deisopentanized feed (23.07 kg/h) penetrated into the bed. The straight chain and mono-branched paraffins were then adsorbed by the silicalite, displacing the adsorbed isopentane. Under the operating conditions, the multi-branched paraffins, aromatic compounds and naphthenic compounds were not adsorbed. The injection points for the feed, raffinate and extract were continuously displaced. This process produced a stream which was rich in di-branched paraffins, naphthenic compounds and/or aromatic compounds and isopentane at a rate of 29.26 kg/h and with an octane number of 94.16. This stream was deisopentanized in deisopentanizer No.2 to recycle isopentane to separation unit 3. Part of the liquid isopentane recovered from the head condenser of deisopentanizer No.2 was sent as a reflux to the column, and the other part as a recycle of eluent for separation unit 3. The recycle was at a flow rate of 20.9 kg/h. A stream 17 which was rich in di-branched paraffins, in naphthenic and/or aromatic compounds, the simplified composition of which is shown in Table 7, was recovered from the bottom of the second deisopentanizer.

The stream from separation unit 3 containing straight chain paraffins, mono-branched paraffins and a portion of the desorbent was produced at a flow rate of 51.45 kg/h and with a research octane number of 78.47. It contained 71% by weight of isopentane.

This stream was then sent to a third deisopentanizer to obtain:

isopentane from the column head, part of which was recycled to separation unit 3 as an eluent, at a flow rate of 36.75 kg/h; and the desired straight chain and mono-branched paraffins (stream 15) from the bottom of the column, at a flow rate of 14.7 kg/h and with a research octane number of 42.9. This stream contained traces of multi-branched paraffins in an amount of 5% by weight.

This stream was depressurised to a pressure of 0.2 MPa and 100° C. to supply separation unit 2 consisting of a gas permeation unit. This unit was constituted by a bundle of alumina tubes with an internal surface coated with a 20 micron thick layer of silicalite. The total useful surface area of the membrane was 5 $m^2$. The gaseous feed was distributed on the inside of the tubes, the flushing gas originating from the first deisopentanizer and the fourth deisopentanizer (described below) was introduced after depressurization to atmospheric pressure and reheating to 100° C. in the permeator shell and was recovered at the other extremity with the straight chain paraffins. The flushing gas was introduced into and extracted from the permeator shell such that the feed and permeate fluids circulated in a counter-current.

The rates of circulation of said fluids were selected so as to keep the flow turbulent.

The straight chain paraffins were preferentially adsorbed into the zeolite (silicalite) cavities, and diffused due to the chemical potential gradient either side of the membrane maintained by the above operating conditions. The straight chain paraffin depleted feed recovered from the permeator outlet (stream 16: flow rate 4.39 kg/h) contained 7.8% by weight of straight chain paraffins and 6.8% by weight of isopentane. The composition of stream 16 is given in Table 7. The flushing gas, during its circulation in the permeator, became loaded with straight chain paraffins and a small quantity of mono-branched paraffins which had also permeated through the membrane. It left the permeator at a flow rate of 15.54 kg/h with a proportion of 31.2% by weight of isopentane. This stream was sent to deisopentanizer No.4, where isopentane was extracted overhead. A portion of this isopentane was sent as a reflux to deisopentanizer No.4; a further portion (2.3 kg/h) in vapour form was reheated and, combined with the overhead stream from deisopentanizer No.1, was introduced into the permeator as a flushing gas, at a flow rate of 5 kg/h. Further, a head purge from this deisopentanizer extracted a stream of 2.4 kg/h. A stream 14 which was rich in straight chain paraffins was produced from the bottom of deisopentanizer No.4 at a flow rate of 10.61 kg/h. Its composition is given in Table 7 below.

TABLE 7

| Composition of stream 14, rich in straight chain paraffins | (wt %) | Composition of stream 16, rich in mono-branched paraffins | (wt %) | Composition of stream 17, rich in di-branched paraffins | (wt %) |
|---|---|---|---|---|---|
| nC5 | 35.93 | isopentane | 6.8 | | |
| nC6 | 37.27 | mono-branched C6 | 60.3 | di-branched C6 | 16.1 |
| nC7 | 17.57 | mono-branched C7 | 19.3 | di- and tri-branched C7 | 6.4 |
| nC8 | 2.65 | mono-branched C8 | 4.5 | di- and tri-branched C8 | 3.2 |
| mono-branched compounds | 6.57 | di-branched compounds | 1.5 | mono-branched compounds | 0.5 |
| | | straight chain compounds | 7.6 | naphthenes | 58 |
| | | | | aromatics | 15.8 |
| RON | 35 | RON | 65.3 | RON | 94 |

The quantity of isopentane recycle circulating in the closed loop between the permeator and deisopentanizer was a variable of the process. For the same surface area of membrane installed, it was possible to operate with ratios of the flow rates of the flushing gas to the feed in the range 0 to 3. When this ratio increased, the quantity of straight chain paraffins permeating through the membrane increased, the increase occurring to the detriment of the purity of the straight chain paraffins extracted.

Overall, the process of the invention led to the production of three effluents, respectively rich in straight chain paraffins, mono-branched paraffins and in multi-branched paraffins, naphthenic compounds and/or aromatic compounds, from a straight run C5–C8 cut comprising paraffinic, naphthenic and/or aromatic compounds.

Example 3

Process for separation into three effluents using two units operating by gas phase adsorption In order to illustrate version 2 of the invention, an example will now be given in which the two separation steps were carried out by gas phase adsorption employing a PSA technique, using a straight run C5–C8 cut comprising paraffinic, naphthenic, aromatic and olefinic hydrocarbons.

The fresh feed for the process had the composition indicated in Table 8 and as a result a research octane number of 73.1 and a motor octane number of 70.33.

TABLE 8

| Components | Weight, % |
|---|---|
| iC4 | 0.01 |
| nC4 | 0.46 |
| nC5 | 9.10 |
| iC5 | 6.10 |
| cyclopentane | 0.61 |
| nC6 | 6.38 |
| mono-branched C6 | 6.43 |
| di-branched C6 | 1.31 |
| cyclohexane | 3.87 |
| methylcyclopentane | 3.01 |
| nC7 | 6.23 |
| mono-branched C7 | 4.18 |
| di-branched C7 | 2.43 |
| tri-branched C7 | 0.46 |
| dimethylcycloC5 | 4.24 |
| methylcycloC6 | 20.10 |
| nC8 | 2.91 |
| mono-branched C8 | 2.18 |
| di-branched C8 | 1.31 |
| tri-branched C8 | 0.64 |
| trimethylcycloC5 | 6.00 |
| ethylbenzene | 0.92 |
| toluene | 10.00 |
| benzene | 1.16 |

Fresh feed arrived via line 1 at a rate of 26.29 kg/h. This feed was deisopentanized in a first deisopentanizer. The light fraction recovered from the head of the first deisopentanizer No.1 had the composition shown in Table 9, a research octane number of 92.4 and was at a rate of 2.44 kg/h. This fraction was used as a flushing gas for the PSA process in separation unit 2.

TABLE 9

| Component | Weight, % |
|---|---|
| nC4 | 4.8 |
| iC4 | 0.10 |
| iC5 | 95.1 |

The deisopentanized feed, pre-heated to 250° C. and at a pressure of 1.4 MPa, arrived in separation unit 2. This unit comprised 4 adsorbers which were cylinders with an internal diameter of 0.3 m and a length of 2.2 m, each containing 108 kg of silicalite in the form of 1.2 mm diameter beads. The feed and desorbent were supplied to the separation unit at a controlled flow rate and the effluents were recovered under controlled pressure. In the four adsorber PSA, each of the adsorption beds underwent the following steps in a cycle:

1. Pressurisation: the deisopentanized feed (23.86 kg/h) penetrated into the bed which contained desorption gas at low pressure. The pressure rose in the adsorber as the feed was introduced, until an adsorption pressure of 1.4 MPa had been reached.

2. Adsorption: the feed was sent co-currently with the pressurisation step to the bed and straight chain and mono-branched paraffins were selectively adsorbed onto the silicalite, while the multi-branched paraffins and the aromatic and naphthenic compounds were produced as an effluent in this high pressure adsorber.

3. Depressurization: when the adsorbent was sufficiently loaded with straight chain paraffins and mono-branched paraffins, a depressurization step to 0.3 MPa was carried out co-currently with the pressurisation and adsorption steps. During this step, a large part of the multi-branched paraffins contained in the dead volume of the adsorber were produced.

4. Stripping by flushing gas: the light fraction produced by deisopentanizers No.1 and No.2 was used as a flushing gas to desorb the majority of the straight chain paraffins and mono-branched paraffins.

The operation described above was that of one of the adsorbers. The four adsorbers which formed separation unit 2 operated in the same way but were offset to result in continuous production of two effluents. The production stream 5 which was rich in multi-branched paraffins and in naphthenic and/or aromatic compounds, was produced at a flow rate of 14.2 kg/h and with a octane number of 86.1. This stream contained 4.4% of isopentane and 6.3% of straight chain and mono-branched paraffins. The stripping stream containing the straight chain and mono-branched paraffins and isopentane was produced at a flow rate of 11.8 kg/h. The stream was then sent to deisopentanizer No.2 to obtain isopentane which was recycled as a flushing gas to separation unit 2 at a flow rate of 1.5 kg/h, and the desired straight chain and mono-branched paraffins (stream 4) at a flow rate of 10.3 kg/h and with a research octane number of 42.75 (composition shown in Table 10). This stream 4 contained traces of multi-branched paraffins, aromatic compounds and naphthenic compounds in an amount of 14%.

Stream 4 was then sent to separation unit 3. This unit also operated using the PSA separation technique. It included 4 adsorbers which were cylinders with a 0.25 m internal diameter and a length of 2 m, each containing 70 kg of 5A molecular sieve (5A zeolite), in the form of 1.2 mm diameter beads. Each of the adsorption beds of unit 3 underwent the same cyclical steps as those described for separation in unit 2. During the pressurisation and adsorption steps, the adsorbers were supplied with a stream which was rich in straight chain and mono-branched paraffins (stream 4). The straight chain paraffins were preferentially adsorbed on the 5A zeolite, displacing the adsorbed isopentane present in the adsorber following the stripping step. Under the adsorber operating conditions, the mono-branched paraffins were not adsorbed and were produced as an effluent from the high pressure adsorber (1.4 MPa). The co-current depressurization step at 0.3 MPa produced a large portion of the non adsorbed compounds contained in the dead volume of the adsorber. Finally, a fraction of the isopentane from deisopentanizers No.1, No.2 or No.3 was then used as a flushing gas to desorb the majority of mono-branched paraffins from the 5A zeolite. The four adsorbers which formed separation unit 3 operated in the same way but offset to result in continuous production of two effluents. The flushing gas containing the straight chain paraffins and isopentane was produced at a flow rate of 5.75 kg/h. It contained 13.66% of multi-branched paraffins, aromatic compounds and naphthenic compounds. This stream was then sent to deisopentanizer No.3 to obtain isopentane which was recycled to the separation units 2 and 3 as a desorption gas, and the desired straight chain paraffins (stream 6: flow rate 5.2 kg/h, octane number 22.4, composition given in Table 10). The production stream 7, rich in mono-branched paraffins, was produced at a flow rate of 7 kg/h. This stream also included 26.85% of isopentane. Its composition is given in Table 10 and its octane number was 72.6.

This process required a recycle, in a closed loop, of a certain quantity of isopentane between deisopentanizers No.1, No.2 and No.3 and separation units 2 and 3. The flow rate of the desorption gas was adjusted depending on the specifications of the separation unit. A portion of this desorption gas circulating in the closed loop could be recovered:

in streams 5, 6, 7;

in the light fractions from deisopentanizers No.2 and No.3.

This quantity of desorption gas so recovered corresponded to the quantity of light fraction extracted by deisopentanizer No.1 from the fresh feed the composition of which is shown in Table 9.

TABLE 10

| Composition of stream 6, rich in straight chain paraffins | (wt %) | Composition of stream 7, rich in mono-branched paraffins | (wt %) | Composition of stream 5, rich in multi-branched paraffins, aromatics and naphthenics | (wt %) |
|---|---|---|---|---|---|
| nC5 | 27.1 | iC5 | 26.8 | isopentane | 4.4 |
| nC6 | 28.32 | mono-branched C6 | 22.6 | multi-branched | 10.3 |
| nC7 | 27.65 | mono-branched C7 | 14.7 | aromatics | 20.2 |
| nC8 | 12.9 | mono-branched C8 | 7.65 | naphthenes | 63.3 |
| mono and multi-branched compounds | 4 | straight chain and multi-branched | 28 | straight chain and mono-branched | 1.9 |
| RON | 22 | | 72.6 | | 86.1 |

Overall, the process of the invention led to the production of three effluents, respectively rich in straight chain paraffins, in mono-branched paraffins and in multi-branched paraffins, naphthenic compounds and/or aromatic compounds, from a straight run C5–C8 cut comprising paraffinic, naphthenic and/or aromatic compounds.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various, usages and conditions.

What is claimed is:

1. A process for separating a $C_{5-8}$-, $C_{6-8}$-, $C_{7-8}$-, $C_{6-7}$-, $C_7$- or $C_8$- hydrocarbon cut, each containing more than 12 mole % of $C_{7+}$ hydrocarbons and optionally naphthenic, aromatic and/or olefinic hydrocarbon, in a feed, comprising separating straight chain paraffins from branched paraffins in the feed in a first separation unit, producing a denormalized feed, and separating mono-branched paraffins from multi-branched paraffins and optional naphthenic and/or aromatic compounds in a second separation unit, said separation units being either an absorption unit or a permeation separation unit, said process further comprising employing at least one adsorbable eluent for regenerating said adsorption unit or a flushing gas for regenerating said permeation separation unit, said eluent or gas being isopentane, n-pentane or isohexane.

2. A process according to claim 1, wherein the feed comprises a C5 cut and isopentane from this cut is separated with the mono-branched paraffins.

3. A process according to claim 1, wherein the feed comprises a C5 cut and isopentane from this cut is extracted from streams traversing the process using a deisopentanizer disposed upstream of one (or the) separation unit(s).

4. A process according to claim 1, wherein the feed comprises the C5 cut and the isopentane from that cut is extracted from the streams traversing the process using a depentanizer disposed downstream of the separation units.

5. A process according to claim 1, wherein it wherein the process employs at least two separation units operating by adsorption.

6. A process according to claim 1, it wherein the process employs at least one separation unit operating by adsorption and at least one permeation separation unit employing one or more membranes.

7. A process according to claim 5, comprising employing the extracted isopentane as an eluent for regenerating the adsorption separation unit or units.

8. A process according to claim 1, it wherein the process employs at least two permeation separation units employing one or more membranes.

9. A process according to claim 8, comprising flushing with the extracted isopentane as a flushing gas to regenerate the permeation separation unit or units.

10. A process according to claim 1, wherein the feed originates from atmospheric distillation.

11. A process according to claim 1, wherein the feed originates from a reforming unit.

12. A process according to claim 1, wherein the feed originates from a conversion unit.

13. A process according to claim 11, wherein the feed is a light reformate.

14. A process according to claim 12, wherein the feed originates from a naphtha hydrocracking unit.

15. A process for separating a $C_{5-8}$-, $C_{6-8}$-, $C_{7-8}$-, $C_{6-7}$-, $C_7$- or $C_8$- hydrocarbon cut, each containing more than 12 mole % of $C_{7+}$ hydrocarbons and optionally naphthenic, aromatic and/or olefinic hydrocarbons in a feed, comprising separating multi-branched paraffins and optional naphthenic and/or aromatic compounds from straight chain and mono-branched paraffins in a first separation unit, sending said straight chain and mono-branched paraffins to a second separation unit and separating an effluent rich in mono-branched paraffins, and an additional effluent rich in straight chain paraffins, said separation units being either an adsorption unit or a permeation separation unit, said process further comprising employing at least one adsorbable eluent for regenerating said adsorption unit or a flushing gas for regenerating said permeation separation unit, said eluent or gas being isopentane, n-pentane or isohexane.

16. A process according to claim 15, wherein the feed comprises a C5 cut and isopentane from this cut is separated with the mono-branched paraffins.

17. A process according to claim 15, wherein the feed comprises a C5 cut and isopentane from this cut is extracted from streams traversing the process using a depentanizer disposed upstream of one separation unit.

18. A process according to claim 15, wherein the feed comprises the C5 cut and the isopentane from that cut is extracted from the streams traversing the process using a depentanizer disposes downstream of the separation unit.

19. A process according to claim 15, wherein the process employs at least two separation units operating by adsorption.

20. A process according to claim 15, wherein the process employs at least one separation unit operating by adsorption and at least one permeation separation unit employing one or more membranes.

21. A process according to claim 15, comprising employing extracted isopentane as an eluent for regenerating the adsorption separation unit or units.

22. A process according to claim 15, wherein the process employs at least two permeation separation units employing ore or more membranes.

23. A process according to claim 15, comprising flushing with extracted isopentane as a flushing gas to regenerate the permeation separation unit or units.

24. A process according to claim 15, wherein the feed originates from atomospheric distillation.

25. A process according to claim 15, wherein the feed originates from a reforming unit.

26. A process according to claim 15, wherein the feed originates from a conversion unit.

* * * * *